United States Patent [19]

Damron

[11] 4,027,645

[45] June 7, 1977

[54] ARCHERY BOW WITH ARROW GUIDING DEVICE

[76] Inventor: William M. Damron, 458 S. 97th Place, Mesa, Ariz. 85208

[22] Filed: Nov. 24, 1975

[21] Appl. No.: 634,626

[52] U.S. Cl. ..... 124/24 R; 124/41 A

[51] Int. Cl.[2] ..... F41B 5/00

[58] Field of Search ..... 124/23 R, 24 R, 83, 124/84, 86, 90, 80, 41 A, 41 R, 35 R, 35 A

[56] References Cited

UNITED STATES PATENTS

| | | | |
|---|---|---|---|
| 353,430 | 11/1886 | Reynolds | 124/41 R |
| 1,526,176 | 2/1925 | O'Connell | 124/24 R |
| 1,689,141 | 10/1928 | Keller | 124/90 X |
| 2,214,224 | 9/1940 | Douglas | 124/24 R X |
| 3,050,046 | 8/1962 | Love | 124/35 R X |
| 3,125,998 | 3/1964 | Stevens | 124/35 R X |
| 3,483,857 | 12/1969 | Jones | 124/35 R X |
| 3,739,765 | 6/1973 | Moore | 124/35 X |

*Primary Examiner*—Richard C. Pinkham
*Assistant Examiner*—William R. Browne
*Attorney, Agent, or Firm*—Warren F. B. Lindsley

[57] ABSTRACT

The tube assembly includes a first hollow tubular portion and a second hollow tubular portion, the latter portion being detachably connected to the first hollow tubular portion. A finger guard is mounted along a portion of the length of the assembly to protect the user's fingers from the protruding portions of an arrow passing through the assembly.

9 Claims, 10 Drawing Figures

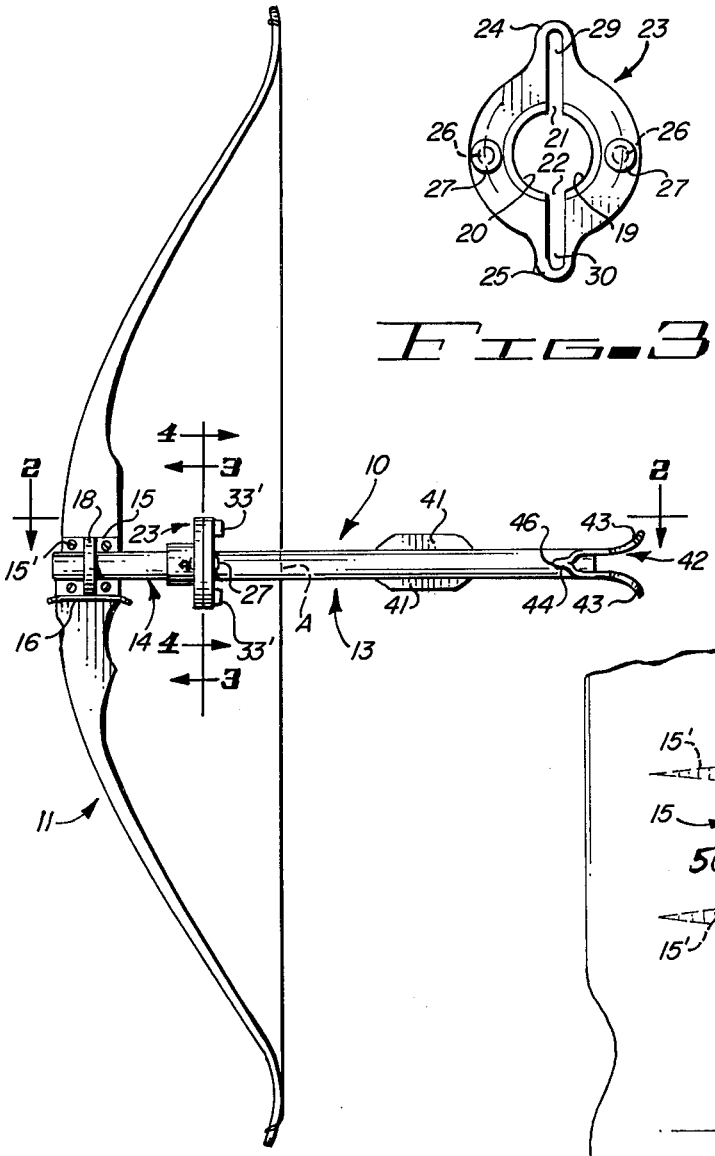
FIG-1
FIG-3
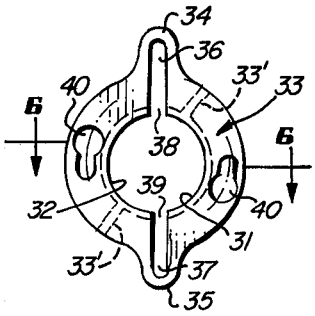
FIG-4
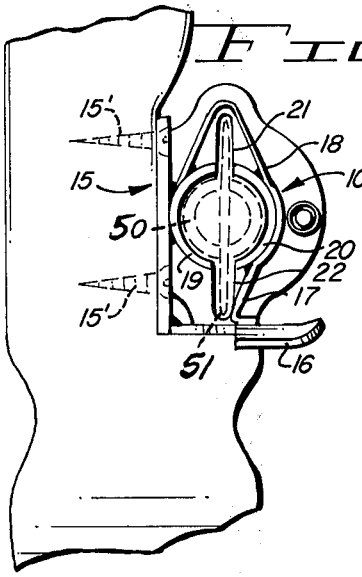
FIG-5
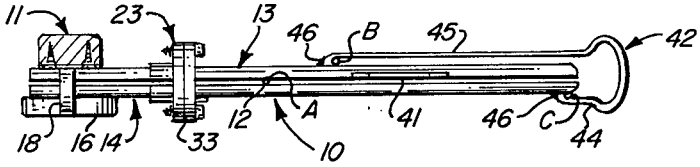
FIG-2
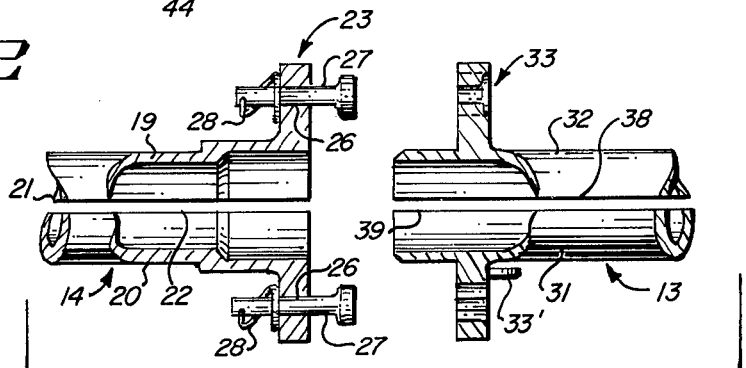
FIG-6

ARCHERY BOW WITH ARROW GUIDING DEVICE

BACKGROUND OF THE INVENTION

This invention relates to guiding and launching tubes for use in conjunction with archery bows and arrows.

1. Field of the Invention

This invention is directed to a tubular guiding and launching device useable in conjunction with conventional bows and arrows but is particularly useful in launching much shorter arrows such as arrows of 3 or 4 inches in length.

2. Description of the Prior Art

Heretofore arrow launching tubes have been designed for attachment to somewhat unconventional bows which assist the archer in holding, launching and guiding an arrow through the tube in a controlled path or trajectory toward the target.

Some of these launching tubes were too short in length to provide even a small degree of guidance for a conventional length arrow. Others long enough to provide some guidance of the arrow were quite complicated consisting of a number of parts that would be expensive to fabricate and difficult to attach to a conventional bow without necessitating considerable alteration of the bow. These launching tubes required a large diameter bore in order for a broadhead hunting tip and the fletchings or feathers of the arrow to pass through the tube without excessive friction and damage to the same, thereby decreasing the degree of guidance the launching tube could provide for the flight of the arrow.

SUMMARY OF THE INVENTION

In order to obviate the disadvantages and incapabilities of the above described types of arrow launching tubes, a new and improved guiding and launching tube assembly is provided consisting of two separable components one of which is detachably secured to or made a permanent integral part of the bow at its spine-point and the other component is detachably connected to the rear end of the first component in longitudinal alignment to form a continuous launching tube assembly. The launching tube assembly provides an aligned arrow guiding means the full length of the connected tubes and employs a bowstring holding or resting means in the rear portion of the launching tube assembly.

It is, therefore, one object of this invention to provide a new and improved lightweight, inexpensive arrow guiding and launcing tube assembly the front end of which is detachably secured to the side of a conventional archery bow in proper relationship to its spine-point for supporting, guiding and launching an arrow.

Another object of this invention is to provide a new and improved arrow launching tube assembly comprising two separable tubular parts one of which may be detachably secured to the side surface of a conventional archery bow at its spine-point or made a permanent integral part of the bow and the other of which is detachably secured in longitudinal aligned relationship with the rear end of the first part to form an extension of the launching tube.

A still further object of this invention is to provide an improved guiding and launching device for long or short arrows comprising two separable tubular components one of which is provided with attaching means for securing its front end to the side surface of an archery bow in rearwardly extending perpendicular relationship thereto and provided at its rear end with a ring or circular flange. The flat end surface of the ring is provided with a large diameter counterbore adapted to receive and mate with the forwardly extending front end of the first component to form a quick detachable connecting means for securing the tubular components in longitudinally aligned, assembled relationship and having a slot formed in the components providing a continuous aligned vertical passage throughout the length of the launching device which serves to receive and guide a broadhead tip arrow head and the fletchings of an arrow in its passage through the tubular launching device and out its open end in true controlled flight toward a target.

A still further object of this invention is to provide an improved guiding and launching device that may be used in conjunction with arrows of any desired length and a conventional archery bow for controlling the flight pattern of the arrows and employing means for resting and holding the partly drawn bowstring subsequent to the launching of the arrow.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

FIG. 1 is a side elevational view of a conventional archery bow showing the assembled arrow guiding and launching device of this invention attached to one side of the bow in readiness for launching an arrow.

FIG. 2 is a combination top plan and sectional view of the assembled arrow guiding and launching device of FIG. 1 taken on the line 2—2 of that figure.

FIG. 3 is a rear end elevation view partly in section, taken on the line 3—3 of FIG. 1 and showing the relationship of the arcuate segments of the front stub portion of the tubular arrow launching device to its integral connecting ring flange.

FIG. 4 is a front end elevational view partly in section taken on the line 4—4 of FIG. 1 showing the relationship of the arcuate segments of the rear extension portion of the arrow launching device to its integral connecting ring flange.

FIG. 5 is an enlarged fragmentary front elevational view of the archery bow illustrating one method of attaching the front stub portion of the launching device together with its mounting plate, tube segment supporting brace and hand guard to one side of the bow.

FIG. 6 is a fragmentary, exploded sectional view taken substantially on the line 6—6 of FIG. 4 showing the mating rear and front ends of the respective stub and extension portions of the split launching tube device with their mating integral ring connecting flanges and one form of connecting means therefor.

DESCRIPTION OF THE PREFERRED EMBODIMENT

Figure 7:
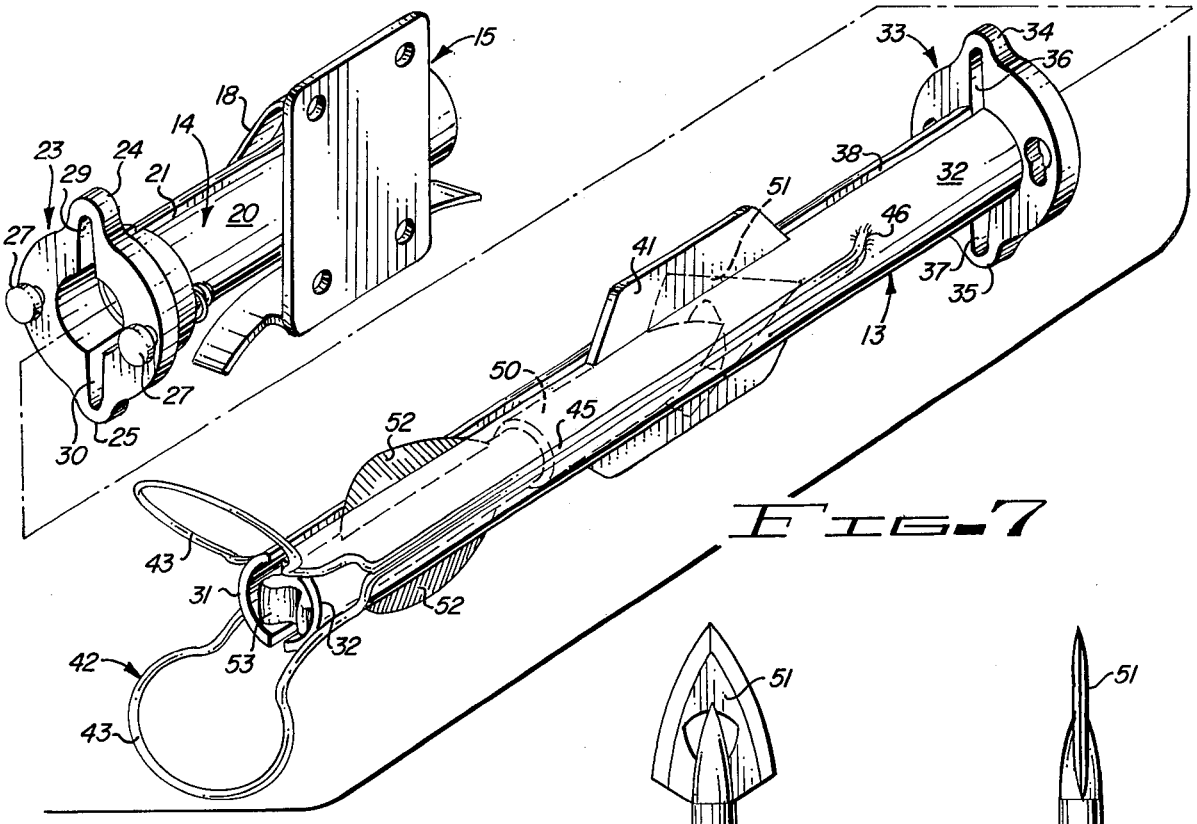
FIG. 7 is an exploded perspective view showing the stub and extension portions of the split launching tube device in their respective ready for assembly relationship for attachment to the side of a bow with a short conventional arrow in the bore of the split tubular extension portion.

Referring more particularly to the drawings by characters of reference, FIG. 1 discloses an assembled arrow guiding and launching tube 10 attached in operable relationship to one side of a conventional archery bow 11. The usual draw string 12 of the bow is confined in longitudinally movable relationship in the rear split tubular extension portion 13 of the launching tube. In its assembled relationship, portion 13 is detachably connectable to a front split tubular stub portion 14 which is rigidly secured at its front end by means of an attaching plate 15 and screws 15′ to the side of the bow in proper relationship to its spine-point, as shown in FIGS. 3 and 5.

A hand guard 16 which may be integral with or attached to the bottom edge of the attaching plate 15 extends outwardly in right angled relationship therefrom and is secured at its top surface to a depending leg 17 of a specially formed tube supporting brace member 18. Brace member 8 is provided with an outwardly extending curved center section and an inverted V-shaped upwardly extending top section. One leg of the V-shaped top section is secured by welding to the face of the attaching plate 15 and to the outer arcuate surface of one arcuate segments 19 of the launching tube. The other arcuate segment 20 is welded at its contact points with the curved center section of brace 18 to thus retain the segments in true vertically opposed relationship and because each of the opposed segments are less in radial length than one half the desired diameter of the split tube being thus formed. They provide vertically aligned longitudinal slots 21 and 22, respectively, at the top and bottom of the front tubular stub portion 14 of the launching tube extending from end to end of the same. The arcuate segments and the supporting brace 18 are strengthened by welding of segment 19 to the face of the attaching plate 15 at their point of contact.

It should be noted that in order to securely and rigidly attach the front stub portion 14 of the launching tube to the side of a conventional bow in proper functional relationship the only alteration of the bow that is required is to cut out or otherwise provide a notch having a flat vertical surface and a right angled bottom ledge surface against which the rear face of the attaching plate 15 and the bottom surface of the hand guard 16 would contact in flush relationship.

The front split tubular stub portion 14 of the launching tube is provided at its enlarged diameter rear end with a radially extending circular flange 23. Flange 23 is provided with axially aligned radial extensions 24 and 25 and a pair of opposite, axially aligned holes 26 in the rim of the flange adapted to receive and support a pair of large diameter headed pins 27 in spaced relationship so their heads extend a predetermined distance out beyond the flat vertical rear face of the circular flange 23. Such relationship of pins 27 to flange 23 is maintained by a pair of spring washers 28, shown in FIG. 6, the inner ends of which rests in circular grooves formed in pins 27 and bear against the rear face of circular flange 23. The outer ends of the spring washers are retained in apertures provided at the outer ends of the pins.

It should be noted that the circular flange 23 with its radial extensions 25 and 26 is preferably formed as an integral part of the arcuate tube segments 19 and 20 and its radial extensions 24 and 25 are provided with axially and vertically aligned radial slots 29 and 30 that extend longitudinally through the radial extensions to mate in vertical relationship with the vertically aligned longitudinal slots 21 and 22 formed by the tubular arcuate segments 19 and 20. However, it should be understood that circular flange 23 with its radial extensions could conceivably be formed as a separate part and welded or otherwise secured to the enlarged diameter end portions of the arcuate segments in the same relationship to equally well perform the function of providing the vertically and longitudinally aligned slot or passageway throughout the entire length of the stub portion 14.

The rear split tubular extension portion 13 of the guiding and launching tube assembly 10 is comprised of elongated arcuate segments 31 and 32 which are identical in sectional size, shape and form to the arcuate segments 19 and 20 that form the front stub portion 14. Segments 31 and 32 are preferably formed integrally with a circular flange 33 located a predetermined distance to the rear of the front end of these arcuate segments.

The circular flange 33 is a duplicate in size, shape and contour of flange 23 formed at the rear end of the stub portion 14 and is provided with radial extensions 34 and 35, that in turn are provided with the vertically aligned through slots 36 and 37. These slots communicate at their inner ends with longitudinal slots 38 and 39 of the same width as slots 36 and 37 formed by the spacing apart of the elongated arcuate segments 31 and 32 and extend throughout the length of the rear split tubular portion 13.

Flange 33 is also provided with a pair of radially disposed keyhole shaped slots 40 located on the same radius from the axis of the formed split tubular members 13 and 14 with the centers of their smaller radially disposed ends in the same axial horizontal plane as the centers of the pair of holes 26 in flange 23. The centers of the larger, connecting holes are spaced radially and equal distance in opposite directions therefrom. It should be noted that the size of the smaller radially disposed ends of the keyhole shaped slots 40 is the same as the diameter of the pair of through holes 26 in flange 23 of the front stub portion 14. The size or diameter of the larger opposite end holes is slightly larger than the diameter of the heads of pins 27 mounted in holes 26 in the flange 23 of the front stub portion 14.

The rear split tubular extension portion 13 includes a pair of finger lift guards 41 that are mounted in aligned vertical relationship along the top and bottom edges of the longitudinally extending upper and lower slots 38 and 39 of tubular member 13. The finger guards serve to protect, the fingers of an archer from possible injury from a sharp, broadhead tipped arrow as the archer pulls the draw string 12 taut. A further finger guard and brace member 42 is provided at the end of tubular member 13 and may be fabricated from a single length of heavy stiff wire formed to provide upper and lower angular finger guard loops 43. The longitudinally and forwardly extending brace portions 44 and 45 of loops 43 are secured at their inwardly bent forward ends to the sides of the elongated arcuate segments 31 and 32 of the tubular extension portion 13, as indicated at 46 in FIGS. 1, 2 and 7 of the drawings.

The longitudinally extending space formed between the sides of the arcuate segments 31 and 32 and the inside surface of the short and long brace portions 44 and 45 providing a suitable means for sliding and temporarily holding or resting the partially taut bowstring 12, as indicated as B in FIG. 2, and the fully taut bowstring, as indicated at C in the same figure.

Figure 8:
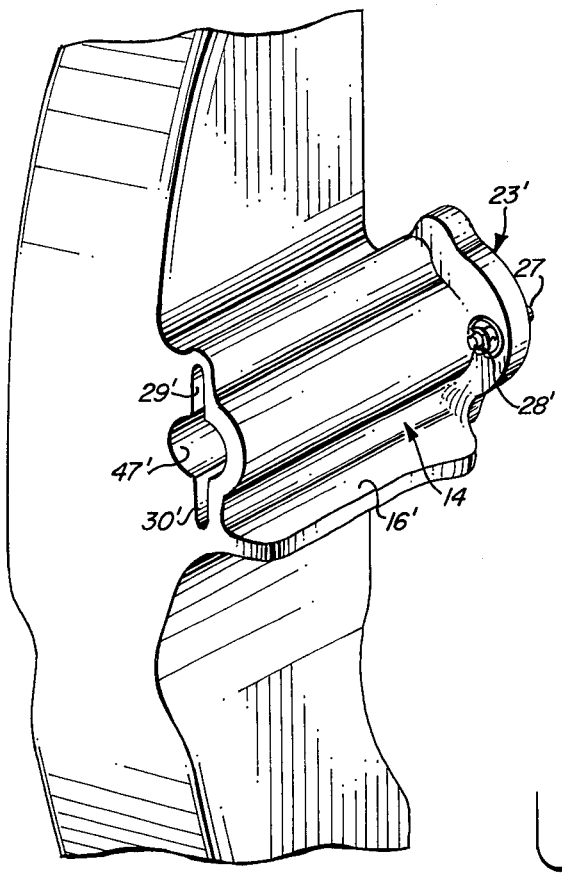
FIG. 8 is a fragmentary perspective view of a modified form of the front stub portion of the split launching tube and showing it as an integral part of the archery bow.

FIG. 8 shows a modified front tubular member 14' employing all the features of the described tubular member 14 but formed as an integral part of an archery bow 11'. This modification discloses a longitudinally extending bore 47' normally formed by the arcuate segments 19 and 20 in tubular member 14 and having vertically aligned longitudinally extending slots 29' and 30' that pass through the circular flange 23'. Flange 23' is shown as having the large diameter headed pins 27' installed therein. A hand guard 16' forms a part of the molded bow configuration and except for pins 27' and their spring washers 28' are all formed integrally with bow 11'. This modification has the advantage of being permanently attached to the bow and always in readiness for use in conjunction with the rear split tubular extension portion 13 which when connected therewith is capable of performing the function of guiding and launching arrows.

Figure 9:
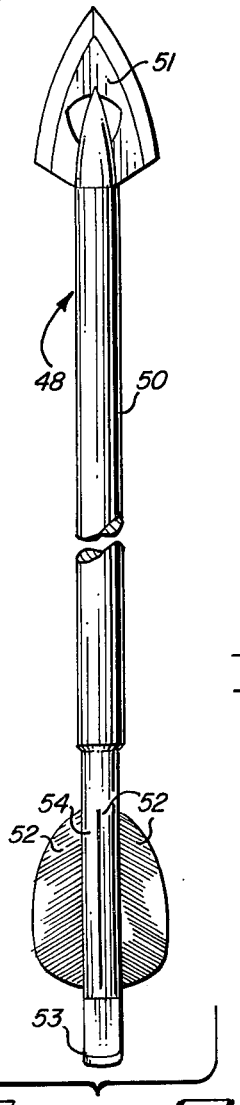
FIG. 9 is a side elevational view of a long arrow that is fitted with a wide, broadhead hunting tip at its front end, typical fletchings or feathers adjacent its reduced diameter rear end and the usual bifurcated draw string receiving nock at its extreme rear end.
Figure 10:
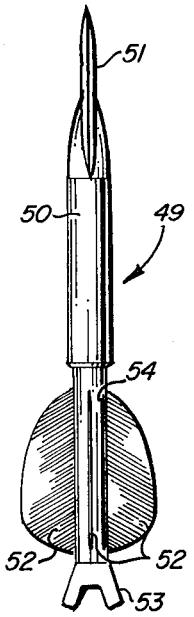
FIG. 10 is a top elevational of a short arrow identical with the long conventional arrow shown in FIG. 9 except for its length.

The long and short arrows 48 and 49, respectively, shown in FIGS. 9 and 10 comprise the usual shafts 50, weighted broadhead hunting tips 51 and feather fletchings 52. The end nocks 53 formed in the shafts are conventional in most respects except for the fact that the rear end portions of shafts 54 contain feather fletching somewhat reduced in diameter varying considerably in their overall length. Since the guiding and launching tube assembly 10 of this invention has the capability of performing its function equally well with either the long (conventional length) arrow 48 or the very short (unconventional length) arrow 49 the two extreme versions of such arrows have been illustrated. Their heads may be as shown or of a rounded type well known for target practice.

It therefore should be noted that the short version of arrow 49, shown in FIG. 10, and in its launching position in the rear split tubular extension portion 13, shown in FIG. 7, is the preferred version since the shorter arrow would have less resistance of "drag" and less side drift due to crosswinds. With its weighted head or tip able to compensate for the reduced weight of the shorter shaft it retains the inertia and penetrating factors of the longer shaft arrows. Further, the length of the tubular stud portion 14 is less than the distance from the spine-point of the bow to relaxed bow string 12. This feature makes it possible to retain the stub portion on the bow at all times.

USE AND OPERATION

The guiding and launching tube assembly 10 of the present invention when properly associated with a conventional archery bow provides a means for guiding and launching an arrow in a controlled flight pattern and may be used by an archer for this purpose with either long or short arrows.

With the front split tubular portion 14 securely attached to the bow in its proper previously described relationship, it is then only necessary to connect the rear split tubular extension portion 13 thereto to complete the assembly of the launching tube in readiness for use. The assembly may be accomplished in the following manner: The large diameter end holes of the keyhole shaped slots 40 in the circular flange 33 of the rear split tubular extension portion 13 are inserted over the large diameter heads of the previously installed pins 27 until the opposed faces of the flanges are in flush contact. Pins 27 protrude out from the rear face of the circular flange 23 on the outer end of the front stub portions 14. Flange 33 of the rear split tubular extension 13 is then rotated in a clockwise direction by means of finger tabs 33' on its rear surface to secure pins 27 in the small ends of the keyhole shaped slots 40. The large diameter heads of the pins prevent any longitudinal separation of the connected flanges thereby causing the mating vertically aligned slots 29 and 30 of the circular flange 23 and the vertically aligned slots 36 and 37 of the circular flange 33 to be held in mating longitudinal relationship. The upper and lower longitudinally extending slots 21–22 and 38–39 formed by the spacing of the arcuate tubular segments 19–20 and 31–32 of the respective front split tubular stub portion 14 and the rear split tubular extension portion 13 are secured in mating vertical and longitudinal alignments to provide a continuous passage for shaft 50, broadhead hunting tip 51 and feather fletchings of an arrow such as arrows 48 or 49.

In order to quickly disassemble the front stub portion 14 from the rear extension portion 13 for purposes of storage or convenient transportation, it would only be necessary to reverse the assembly procedure described above by rotating the flange 33 of the extension portion 13 in the opposite or counterclockwise direction so that the large diameter ends of the keyhole shaped slots 40 are placed in direct alignment with the large heads of the pins 27. The components are then separated by pulling the rear extension portion 13 out and away from the front extension portion by allowing the large diameter heads of the pins 27 to pass through the large diameter ends of the keyhole shaped slots 40.

When using the assembled guiding and launching tube 10 for launching either long or short arrows therefrom, it is only necessary for the archer to hook one end of the detached bowstring 12 on the lower bow limb, pass the other end through the loops of the finger guard and brace member 42 and then slip the same forward in the vertically aligned tube slots 38 and 39 until it assumes the position A in the rear tubular extension portion 13 (as indicated in FIGS. 1 and 2) hooking the same to the upper bow limb in partially taut relationship. Then, if so desired, the archer may pull the bowstring back through the vertically aligned slots and out of the same and let it slide forward in the space formed between the longitudinally, forwardly extending side brace portion 45 of the brace member 42 until it assumes the semi-taut or neutral position indicated by the letter B in FIG. 2 where it may remain until the archer decides to make ready for launching an arrow. He then would again pull the bowstring back out of any contact with the ends of tube split tube segments and let it move forward in the space between the short, longitudinally, forwardly extending portion 46 of the brace member 42 and assume the fully taut relationship indicated by the letter C in FIG. 2.

After placing the bowstring 12 in the latter described position C, the archer would then place either a long or short arrow such as arrow 48 or 49 in the aligned bore formed in the two portions 13 and 14 of the launching tube assembly 10.

The inside diameter of the bore of portions 13 and 14 is only slightly larger than the outside diameter of the main portion of the arrow shafts 50.

The vertically aligned feather fletchings 52 enter the vertically aligned upper and lower longitudinally disposed slots 38 and 59 formed in the rear extension portion 13 with the nock 53 of the arrow flush with the rear ends of the slot forming arcuate segments 31 and 32. The sides of the broadhead hunting tip 51 project in vertical sliding relationship out from the longitudinally extending slots 38 and 39, mentioned above in the manner shown in FIG. 7. In case the longer arrow is used, its tip 51 will be pushed through the mating longitudinally extending slots extending out beyond the front end of the stub portion 14 of the launching tube assembly.

When either long or short arrows are used, the horizontally disposed flexible, resilient feather fletching 52 is compressed into the space formed between the reduced diameter rear end portions 54 and the inside diameter of the split tubular bore of the launching tube assembly. This condition provides a slight drag and stabilization of the arrow as it passes therethrough.

At this point, the archer launches the arrow by pulling the fully taut bowstring 12 out of its resting place or point C allowing it to rest lightly in the nock 53 of the arrow and then releases the string to launch the arrow in a controlled guided path with great velocity and distance carrying inertia.

It should be noted that position B may be used in hunting in order to remove tension from the bowstring thereby assuming a more neutral position. Positions B and C are for the benefit of the archer and may be used as he so desires in any sequence or avoided.

Although but two embodiments of the invention have been illustrated and described, it will be apparent to those skilled in the art that various changes and modifications may be made therein without departing from the spirit of the invention or from the scope of the appended claims.

What is claimed is:

1. Guiding and launching device for arrows comprising:

a hollow launching tube assembly, said assembly comprising a first hollow tubular portion and a second hollow tubular portion coaxially aligned with and detachably connected to said first tubular portion, the portions of said assembly being split along opposite ends of a diameter of said assembly along its length whereby the tips of an arrow head and some of the feathers at diagonally opposite parts of the arrow at its tail end protrude outwardly of the assembly through its slits for guiding of the arrow through the guiding and launching device, means for attaching said first hollow tubular portion of said assembly to the spine point of a bow, and a finger guard means mounted along at least a part of the length of said assembly for protecting the archer's fingers from the protruding portions of an arrow passing through said assembly.

2. The guiding and launching device for arrows set forth in claim 1 in further combination with:

bowstring positioning means mounted on the outer periphery of said second hollow tubular portion and extending from the end closest to the user when in use toward said first hollow tubular portion for positioning of the bowstring prior to manual removal of a bowstring therefrom for releasing to cause an arrow in the tube assembly to be launched.

3. The guiding and launching device set forth in claim 2 wherein:

said bowstring positioning means provides two positions along the outside periphery of said second hollow tubular portion for positioning the bowstring when the latter is semi-taut and fully taut.

4. The guiding and launching device set forth in claim 1 wherein:

said first hollow tubular portion is shorter in length than the distance from the spine point of a bow to its bowstring when the latter is in a neutral condition.

5. A bow for guiding and launching archery arrows comprising:

a bow, a bowstring tautly arranged between the ends of the bow, and a bowstring positioning and launching tube assembly attached to the bow at its spine point for extending laterally of the longitudinal axis of the bow for positioning and manual removal of a bowstring therefrom for launching an arrow, said assembly comprising a first hollow tubular portion attached to the bow at its spline point and a second hollow tubular portion coaxially aligned with and detachably connected to said first tubular portion and positioned between the belly of the bow and the bowstring when the latter is in a neutral position, the portions of said assembly being split along opposite ends of a diameter of said assembly along its length whereby the tips of an arrow head and some of the feathers at diagonally opposite parts of the arrow at its opposite end protrude outwardly of the assembly through its slits for guiding of the arrow through the guiding and launching device, and a finger guard means mounted along at least a part of the length of said assembly for protecting the archer's fingers from the protruding portions of an arrow passing through said assembly.

6. The bow set forth in claim 5 wherein:

the splits of said assembly are substantially aligned with the longitudinal axis of said bow.

7. The bow set forth in claim 5 wherein:

said first portion is integral with and extends through said bow.

8. The bow set forth in claim 5 in further combination with:

an additional finger guard mounted around at least a part of the length of said assembly for protecting the archer's fingers from the protruding portions of an arrow passing through said assembly.

9. The bow set forth in claim 8 wherein:

said bowstring positioning means is provided with at least two positions along the outside periphery of said second hollow tubular portion for positioning the bowstring.

* * * * *